United States Patent [19]

Liptak

[11] 4,125,243

[45] Nov. 14, 1978

[54] SIGN HOLDER

[75] Inventor: Richard M. Liptak, Parma Heights, Ohio

[73] Assignee: Integral Design, Inc., Valley View, Ohio

[21] Appl. No.: 781,703

[22] Filed: Mar. 28, 1977

[51] Int. Cl.[2] ..... A47F 7/14

[52] U.S. Cl. ..... 248/473; 40/11 R; 40/152.1; 248/205 A

[58] Field of Search ..... 248/466, 469, 205 A, 248/473; 40/125 H, 11, 152.1; 24/67R, 67.3, 137R

[56] References Cited

U.S. PATENT DOCUMENTS

| | | | |
|---|---|---|---|
| 1,152,461 | 9/1915 | Wright | 248/473 |
| 1,609,700 | 12/1926 | Dalberg | 248/473 |
| 1,681,586 | 8/1928 | Kessler | 248/473 |
| 1,768,675 | 7/1930 | Egan | 248/473 |
| 1,829,360 | 10/1931 | Lambert | 248/473 |
| 3,258,232 | 6/1966 | Nestegard | 248/473 X |
| 3,261,126 | 7/1966 | Marks | 248/205 A X |
| 3,696,920 | 10/1972 | Lahay | 248/250 A X |

FOREIGN PATENT DOCUMENTS

| | | | |
|---|---|---|---|
| 650,290 | 9/1937 | Fed. Rep. of Germany | 248/473 |
| 365,349 | 1/1932 | United Kingdom | 248/473 |

*Primary Examiner*—Lawrence J. Staab

*Attorney, Agent, or Firm*—Bosworth, Sessions & McCoy

[57] ABSTRACT

A sign holder is disclosed which has a generally flat base of resilient material and two projections thereon. The first projection has a convex, sloped side surface, and the second projection has a corresponding concave, sloped side surface spaced from the convex side surface of the first projection. An arcuate wedge-shaped trough is formed between the side surfaces of the projections. The edge of a sign card or board is inserted in the trough and removably held upright thereby. The wedge shape of the trough and the resilient material of the base combine to firmly grip the edge of the sign card.

2 Claims, 5 Drawing Figures

FIG. 1
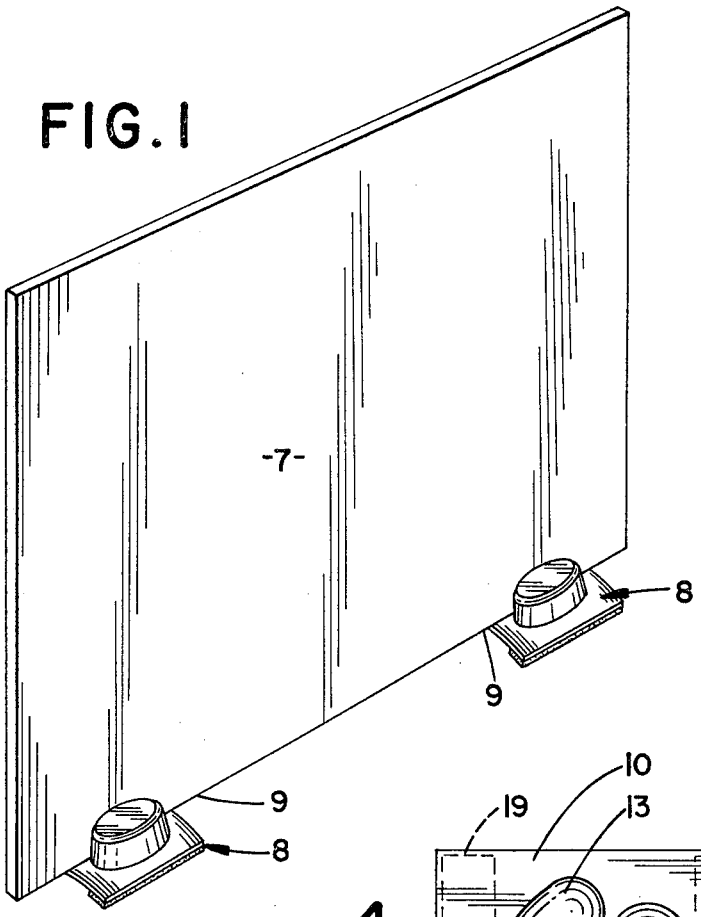
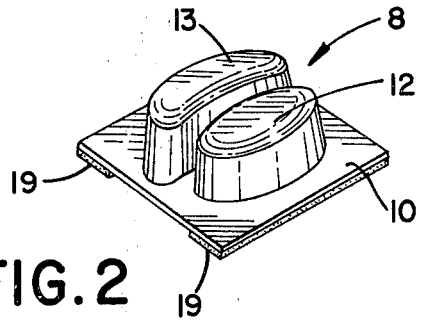
FIG. 2
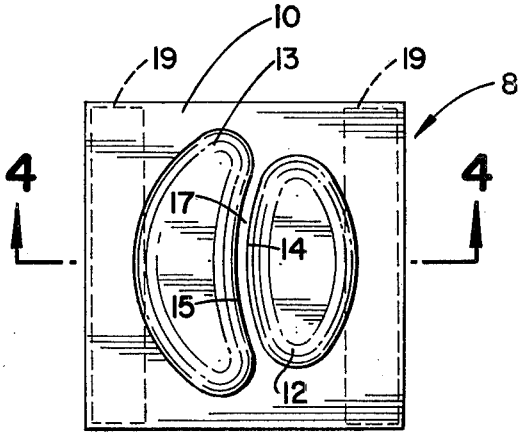
FIG. 3
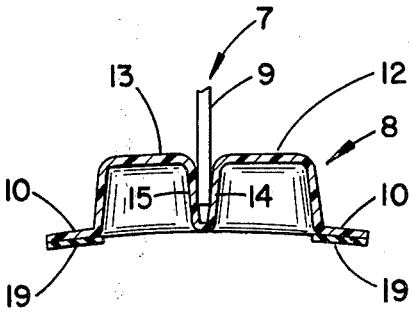
FIG. 5
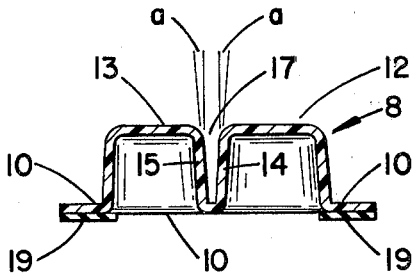
FIG. 4

SIGN HOLDER

BACKGROUND OF THE INVENTION

This invention relates to supports or holders for signs, cards and the like.

Sign holders are used to support sign cards upright for various display purposes, such as for mounting promotional signs on cash registers in retail establishments, for holding price or description signs adjacent to sale merchandise, or for use in displays at industrial shows and in window displays. In the past, sign holders have often employed mechanical clips with spring means to grip the sign and hold it upright. Such holders are relatively expensive and complicated, and are easily broken.

Another type of prior art sign holder has depended upon the natural resilience of the sign card or board. Examples of such holders are shown in U.S. Pat. No. 2,206,775 (Hoofer) and No. 3,779,504 (Schwartz et al.). The patent to Hoofer discloses a holder having a transversely extending curvilineal furrow in which a card or tag is held by reason of the intrinsic resiliency of the card or tag material, whereby it presses against the furrow and frictionally engages with end portions of the furrow sides. In the patent to Schwartz et al., the sign or card is bent and located around and between three posts or pegs upstanding from the base portion of the holder, whereupon the inherent resilience of the card will maintain the card upright.

These prior art sign holders are insufficient and ineffective when the sign or card looses it resiliency or when the card is made from a material which does not have the required resiliency to maintain the card in the holder. Furthermore, these holders have generally been limited to supporting the sign upright along its bottom edge and such holders are unable to adequately grip hanging signs along the side or top edges.

SUMMARY OF THE INVENTION

The problems of the prior art sign holders are overcome by the unique design of the sign holder of the present invention. It is an object of the present invention to provide a reusable sign holder which holds a sign card or board upright without mechanical spring clips or the like and without depending upon the natural resiliency of the sign card. Another object is to provide a sign holder which is esthetically pleasing with attractive contoured surfaces and which has a low profile to minimize copy coverage on the sign. Still another object is to provide a sign holder with a rounded contour at the top and on the sides which aids in guiding the sign into the holder. Yet another object is to provide a sign holder which is adaptable to signs over a wide range of thicknesses. Another object is to provide a sign holder which is capable of firmly gripping the sign to hold the sign in place in any position, including the capability of holding a hanging sign by gripping its top edge.

These and other objects are accomplished by the sign holder of the present invention which comprises a generally flat base of resilient material with two projections thereon. The first projection has a convex, sloped side surface, and the second projection has a corresponding concave, sloped side surface. The side surfaces of the two projections are spaced from each other to form between them an arcuate wedge-shaped trough in which the edge of the sign is inserted. The wedge shape of the trough formed by the sloped side surfaces and the resiliency of the base combine to grip the sign within the trough and hold it securely thereby.

BRIEF DESCRIPTION OF THE DRAWINGS

FIG. 1 is a perspective view of a sign mounted in a pair of sign holders according to the present invention.

FIG. 2 is a perspective view of one of the sign holders of FIG. 1 to a larger scale.

FIG. 3 is a top plan view of the sign holder to a larger scale than FIG. 2.

FIG. 4 is an elevational cross section taken along line 4—4 of FIG. 3.

FIG. 5 is an elevational cross section similar to FIG. 4 with a sign card inserted into the holder, illustrating the gripping effect of the holder.

DETAILED DESCRIPTION OF THE PREFERRED EMBODIMENT

Referring particularly to the drawings and initially to FIG. 1, there is shown a sign card 7 held vertically by a pair of sign holders 8 made according to the present invention. The sign holders 8 are preferably used in pairs for the mounting of most signs of a typical display size. As shown, the holders 8 support the sign card 7 along its bottom edge 9; it is to be understood, however, that the sign holders can be used to support signs along any edge including the support of hanging signs by mounting the top edge of a sign card into sign holders. The holders 8 have a relatively low profile which minimizes the coverage of copy on the sign card 7.

Each sign holder 8 is shown in more detail in FIG. 2. The holder 8 comprises a generally flat base 10 upon which are two projections 12 and 13. The first projection 12 is generally oval-shaped with a convex side surface 14 (FIG. 3). The second projection 13 is generally crescent-shaped with a concave side surface 15 corresponding to and spaced from the convex side surface 14 of the first projection 12. An arcuate trough 17 is formed between the convex side surface 14 of the projection 12 and the concave side surface 15 of the projection 13. The edge of a sign card 7 can be inserted in the trough 17 and held therein. The upper portions of each of the projections 12 and 13 are rounded to aid in guiding the edge of the sign card 7 into the trough 17. The contoured surfaces also produce an esthetically pleasing appearance. The corresponding convex and concave contours of the side surfaces 14 and 15 make the trough 17 arcuate or curved. This curvature of the trough 17 helps to support the sign card 7 because any natural resiliency in the sign card results in a frictional engagement between the edge 9 of the sign card and the projections 12 and 13.

To support sign cards without relying on their natural resiliency, the holders 8 are designed to grip the edge of the sign card when it is inserted in the trough. As shown particularly in FIG. 4, each of the side surfaces 14 and 15 is tilted or sloped to form a slight angle $a$ with the plane perpendicular to the flat base 10. These sloped surfaces result in a trough 17 which is generally wedge shaped in cross section to aid in gripping the edge 9 of the sign card 7. Preferably the angles $a$ are the same and are between about 0.5° and about 5°. In the preferred embodiment of the present invention, each angle $a$ is approximately one degree. (For clarity, these angles have been exagerated slightly in the drawings.)

To assist the wedge-shaped trough gripping the edge of the sign board, the base 10 should be formed of a resilient material, preferably plastic. The sign holders 8 of the present invention may be economically made by thermo-forming, so that the base 10 and the projections 12 and 13 are integrally formed from a single piece of plastic sheet. If the projections are integrally formed with the base, the projections would also necessarily be formed of the resilient plastic material, but the structural design of the projections would add rigidity so that the resiliency in the projections would not adversely affect their sign holding capability.

The resilient material of the base 10 along with the wedge-shaped trough 17 produces a result which firmly grips the sign card in the trough 17, as shown in FIG. 5. When the edge 9 of the sign card 7 is inserted into the holder 8, it is wedged into the trough 17, forcing the side surfaces 14 and 15 of the projections 12 and 13 apart slightly. This wedging force is resisted by the resiliency of the flat base 10 which exerts an opposite force, pushing the projections 12 and 13 together to firmly grip the sign card 7. The force of the base 10 resisting the wedging action in the trough 17 is evidenced by a slight bow in the flat base. The resiliency of the base which permits the projections to separate slightly, widening the trough, along with the wedge shape of the trough 17 also permits the sign holder 8 to accept sign cards having a wide range of thicknesses.

To permit signs to be conveniently mounted on any surface and in any orientation, the sign holder 8 is preferably provided with adhesive means on the bottom surface of the flat base 10. This adhesive means may be in the form of two strips 19 of adhesive. Each adhesive strip 19 is located along the edge of the base 10 running in the same general direction with the trough 17 and on either side of the trough 17. This location of the adhesive strips 19 allows for the proper bowing of the base 10 when thicker sign cards 7 are inserted into the trough 17 (FIG. 5). The adhesive means on the base of the holder assures that a sign will remain in the proper place and permits the holders to be mounted on vertical surfaces or under surfaces.

While the preferred form of this invention has been illustrated and described herein, it will be apparent to those skilled in the art that modifications and improvements may be made to the form herein specifically disclosed. Accordingly, the present invention is not to be limited to any form herein specifically disclosed nor in any other way inconsistent with the progress in the art promoted by this invention.

What is claimed is:

1. A sign holder, comprising:

a generally flat resilient base;

a first projection on the base having a convex, sloped side surface;

a second projection on the base having a concave, sloped side surface spaced apart from the convex side surface of the first projection forming an arcuate wedge-shaped trough therebetween for the insertion of the edge of a sign, the second projection capable of slight movement away from the first projection by bending the resilient base to widen the trough upon the insertion of the edge of a sign; and two strips of adhesive beneath the base extending in the same general direction with and located on either side of the trough to permit the resilient base to be bent.

2. A sign holder comprising:

a generally flat resilient base;

a first oval-shaped projection on the base having a rounded upper portion and having a convex, sloped side surface;

a second crescent-shaped projection on the base having a rounded upper portion and having a concave, sloped side surface spaced apart from the convex side surface of the first projection, an arcuate wedge-shaped trough formed between the convex side surface and the concave side surface, the trough adapted for insertion of a sign; and two strips of adhesive beneath the base extending in the same general direction with and on either side of the trough for mounting the holder to an external surface, the upper portion of the second projection capable of slight movement away from the upper portion of the first projection by bending the resilient base to widen the trough upon the insertion of the edge of a sign.

* * * * *